US009433266B2

(12) United States Patent
Meisenbach

(10) Patent No.: US 9,433,266 B2
(45) Date of Patent: Sep. 6, 2016

(54) WEARABLE DEVICE FOR HIDING KEEPSAKES AND VALUABLES

(71) Applicant: Michelle Meisenbach, Chandler, AZ (US)

(72) Inventor: Michelle Meisenbach, Chandler, AZ (US)

( * ) Notice: Subject to any disclaimer, the term of this patent is extended or adjusted under 35 U.S.C. 154(b) by 0 days.

(21) Appl. No.: 14/706,817

(22) Filed: May 7, 2015

(65) Prior Publication Data

US 2015/0320156 A1 Nov. 12, 2015

Related U.S. Application Data

(60) Provisional application No. 61/991,039, filed on May 9, 2014.

(51) Int. Cl.
*A44C 25/00* (2006.01)
*A44C 15/00* (2006.01)

(52) U.S. Cl.
CPC ..... *A44C 25/002* (2013.01); *A44C 25/001* (2013.01); *A44C 15/003* (2013.01)

(58) Field of Classification Search
CPC .... A44C 21/00; A44C 25/00; A44C 25/001; A44C 3/008
See application file for complete search history.

(56) References Cited

U.S. PATENT DOCUMENTS 509,889 A * 12/1893 Gaynor ..... 63/23
685,526 A * 10/1901 Perry ..... 63/23
1,410,075 A * 3/1922 Orstedt ..... 40/741
2,778,208 A * 1/1957 Flint ..... A44C 3/00 428/28
4,765,154 A * 8/1988 Martin ..... 63/23
5,609,043 A * 3/1997 Benderly ..... 63/23
5,799,511 A * 9/1998 Benderly ..... 63/23
6,422,037 B1 * 7/2002 Benderly ..... 63/23
2001/0017040 A1 * 8/2001 Tseng ..... 63/1.11
2015/0089976 A1 * 4/2015 Alulis et al. ..... 63/21

OTHER PUBLICATIONS

Blooming Violet Studio, Butterfly Lady Tattoo Locket Necklace on black suede leather,https://www.etsy.com/listing/124577891/butterfly-lady-tattoo-locket-necklace-on?ref=sr_gallery_16&ga_search_query=locket+glass+chic&ga_order=most_relevant&ga_page=ga_search_type=all&ga_view_type=gallery; screen shot taken May 7, 2015.

JMarieOfAtlanta, Dance Amulet—Industrial Chic necklace with pearls Swarovski crystals natural crystal music dancer glass pendant, https://www.etsy.com/listing/76010800/dance-amulet-industrial-chic-necklace?ref=sr_gallery_21&ga_search_query=locket+glass+chic&ga_order=rnost_relevant&ga_page=3&ga_search_type=all&ga_view_type=gallery; screen shot taken May 7, 2015.

* cited by examiner

*Primary Examiner* — Emily Morgan
(74) *Attorney, Agent, or Firm* — Venjuris, P.C.

(57) ABSTRACT

This invention is embodied in a wearable device for hiding keepsakes and valuables. The preferred embodiment of the device creates an internal hidden compartment formed between a first face, a second face and a channel-shaped retaining ring.

10 Claims, 8 Drawing Sheets

WEARABLE DEVICE FOR HIDING KEEPSAKES AND VALUABLES

FIELD OF THE INVENTION

The present invention relates to wearable devices for hiding items, and more specifically to wearable jewelry for hiding keepsakes and other valuables.

BACKGROUND

A locket is a jewelry pendant that has been around a long time and is well-known in the art. A locket typically consists of a front face and a back face with a hinge on one side and a ring on the top to accept a necklace. The front and back faces are typically concave surfaces that, when mated, form a shallow internal compartment. This internal compartment is usually sized to hold something the thickness of a photograph or other thin item such as a lock of hair.

Some lockets are made with a clear front face (like glass) so that a person can see what is inside without opening the locket. Such lockets are generally used for items like locks of hair which could fall out and become lost if the locket were repeatedly opened. Other lockets, like a picture locket, are generally enclosed on all sides and the photographs are secured to the inside back face by an assembly to hold the photograph to the back face but allow a viewer to see the photograph when locket is opened.

One drawback with the well-known standard prior art lockets is that the front and back faces are permanently connected to the locket. So, the locket owner has no ability to change the outside look of a locket without buying a new locket.

Another drawback of well-known standard prior art lockets is that the interior space is similar to the interior of a clam shell. Such space is suitable for a pearl or small item. But such a space is not suitable for other shaped items.

SUMMARY OF THE INVENTION

The present invention is incorporated in a wearable device (the "device") 10 for hiding keepsakes and valuables. The device 10 comprises a front face 12, a back face 14, and a channel-shaped retaining assembly 16 configured to create a vault 18 (i.e., an internal hidden compartment to store a keepsake (such as a recovery medallion or chip 24, a small notepad or photo album, money, etc.) between the front face 12 and the back face 14.

The front and back faces 12, 14 are preferably rigid, opaque and adorned with ornamental objects 30 or other decorations. Because the front and back faces 12, 14 are removable when the retaining assembly 16 is in the open position, the front and back faces 12, 14 are changeable by the user.

It is an object of this invention to create a locket that can be changed out to suit one's personal style and taste without having to switch to a completely different locket. Also, the internal hidden compartment is thick enough through the entire width of the piece to hold a coin or notepad or other keepsake thicker than standard photo paper.

The structure, overall operation and technical characteristics of the present invention will become apparent with the detailed description of a preferred embodiment and the illustration of the related drawing as follows.

BRIEF DESCRIPTION OF THE DRAWINGS OR PICTURES

Figure 1:
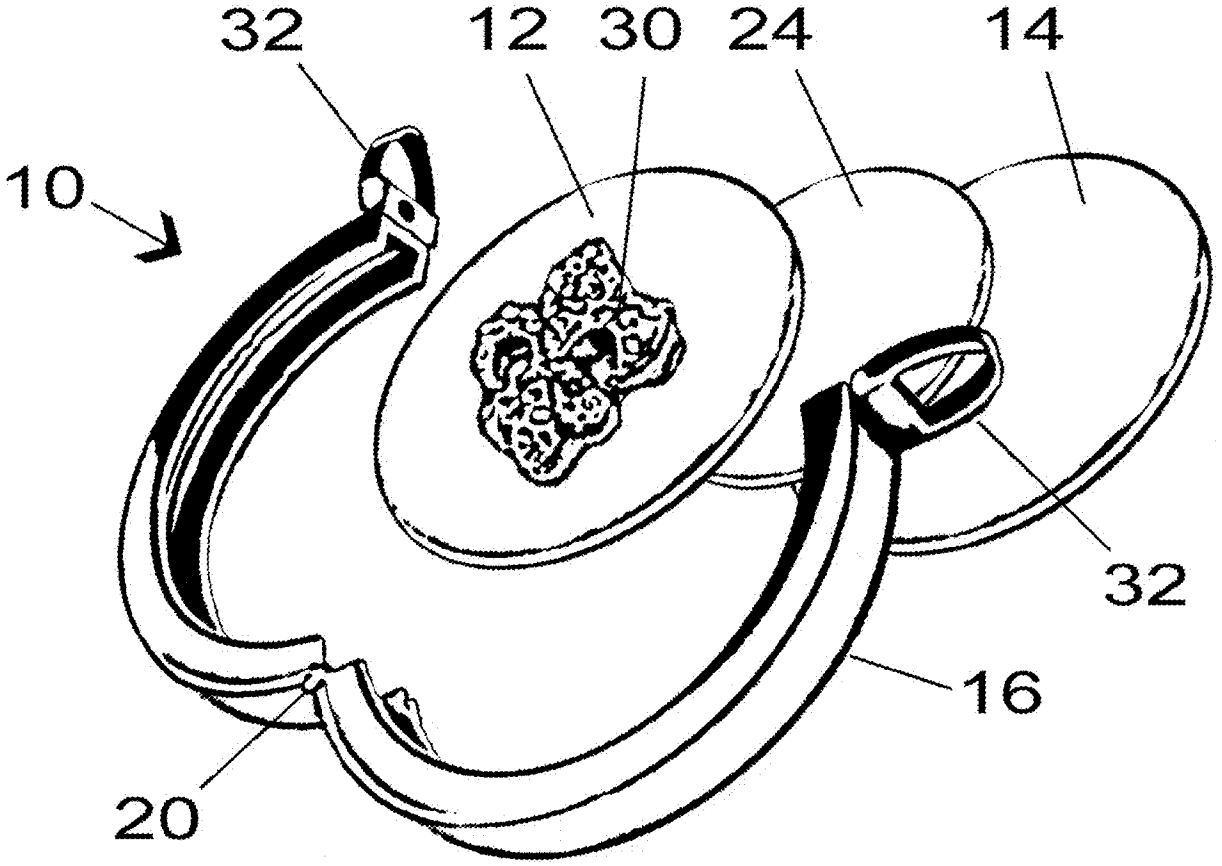
FIG. 1 illustrates a perspective view of an embodiment of the wearable device 10 when the retaining ring 16 is in the open position.
Figure 2:
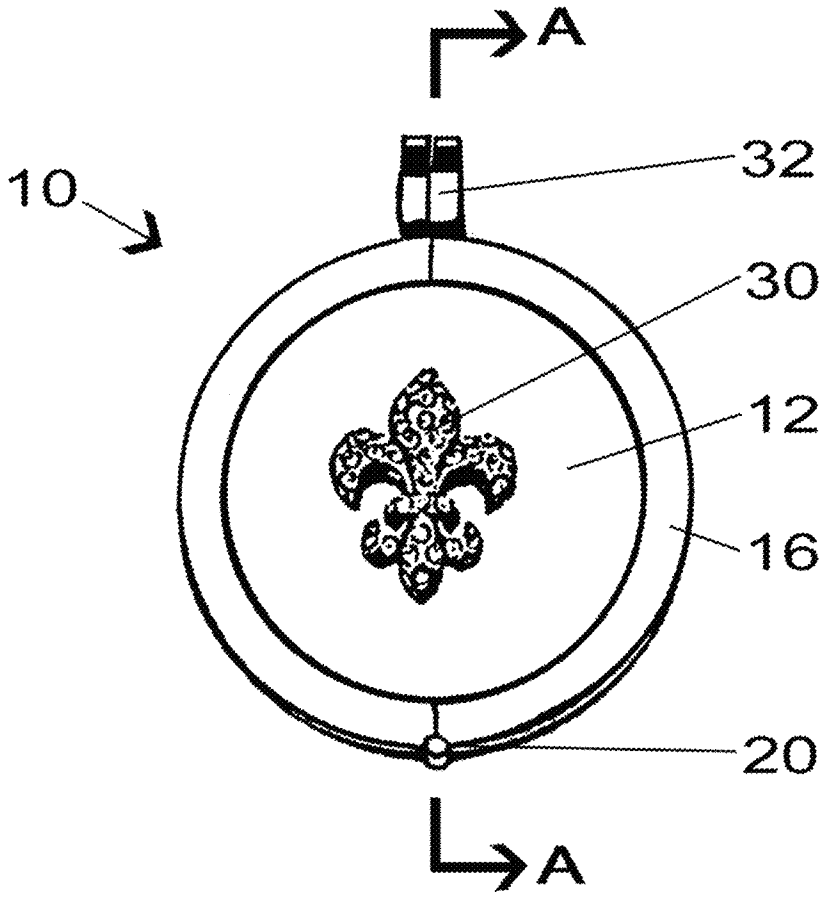
FIG. 2 illustrates a front view of an embodiment of the wearable device in the closed position.
Figure 3:
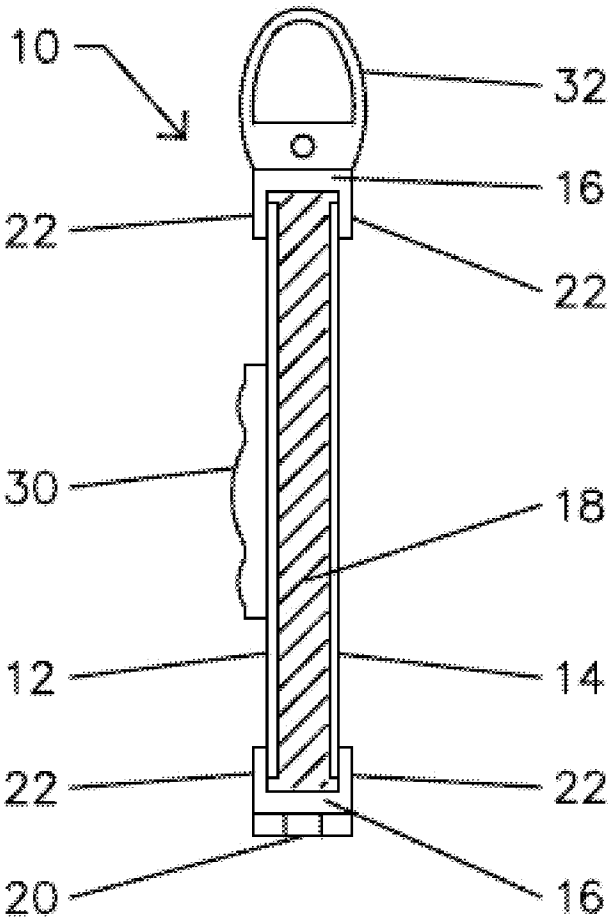
FIG. 3 illustrates section view A-A from FIG. 2, showing an embodiment of the device 10 with an empty vault 18.
Figure 4:
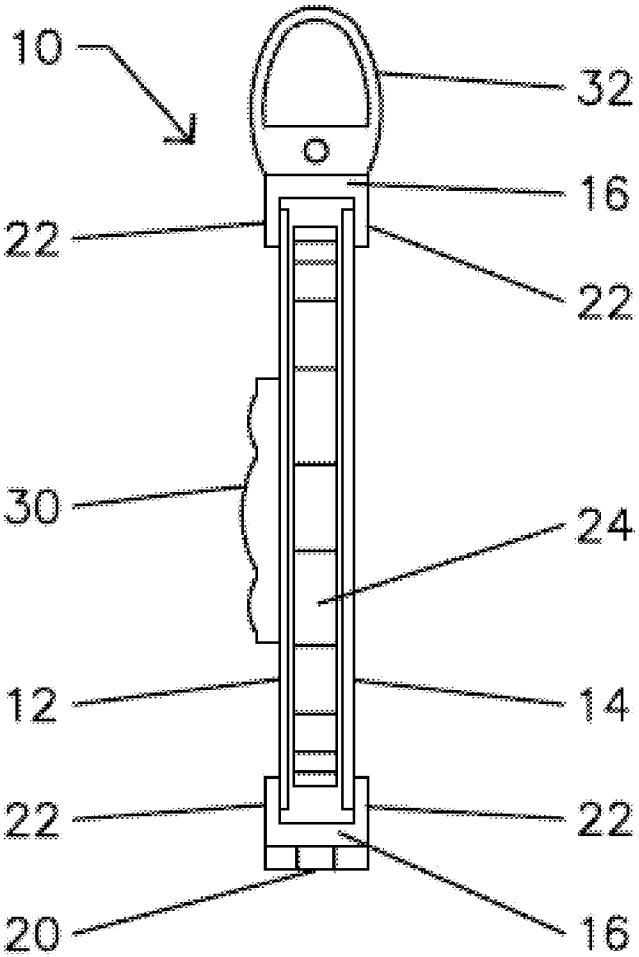
FIG. 4 illustrates section view A-A from FIG. 2, showing an embodiment of the device 10 with a coin-filled vault 24.
Figure 5:
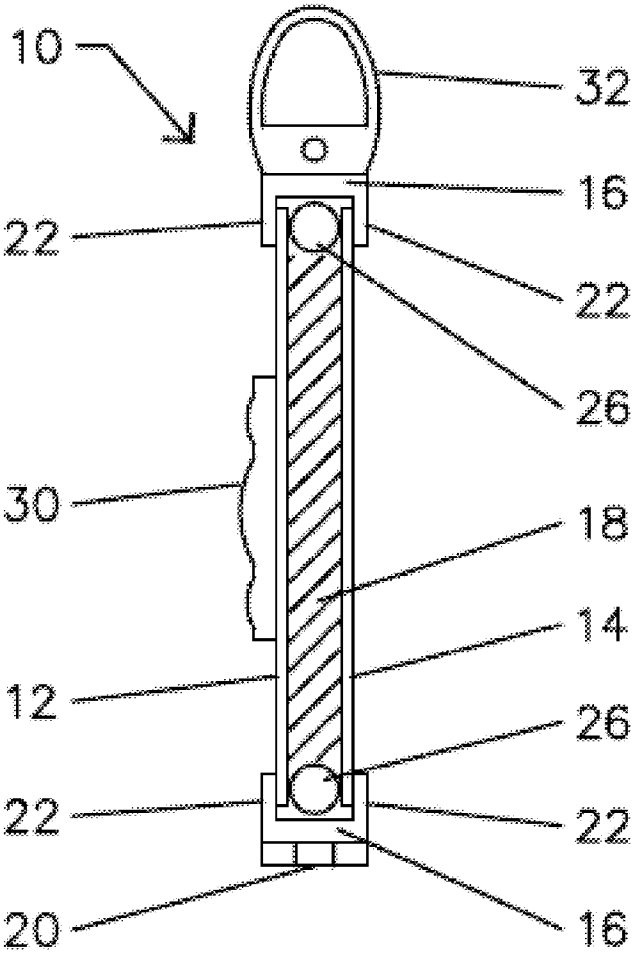

FIG. 5 illustrates section view A-A from FIG. 2, showing an embodiment of the device 10 with an empty vault 18 and a O-ring spacer 26 between the front and back faces 12, 14 which maintains the open void between the front and back faces 12, 14 when the locket is empty.

Figure 6:
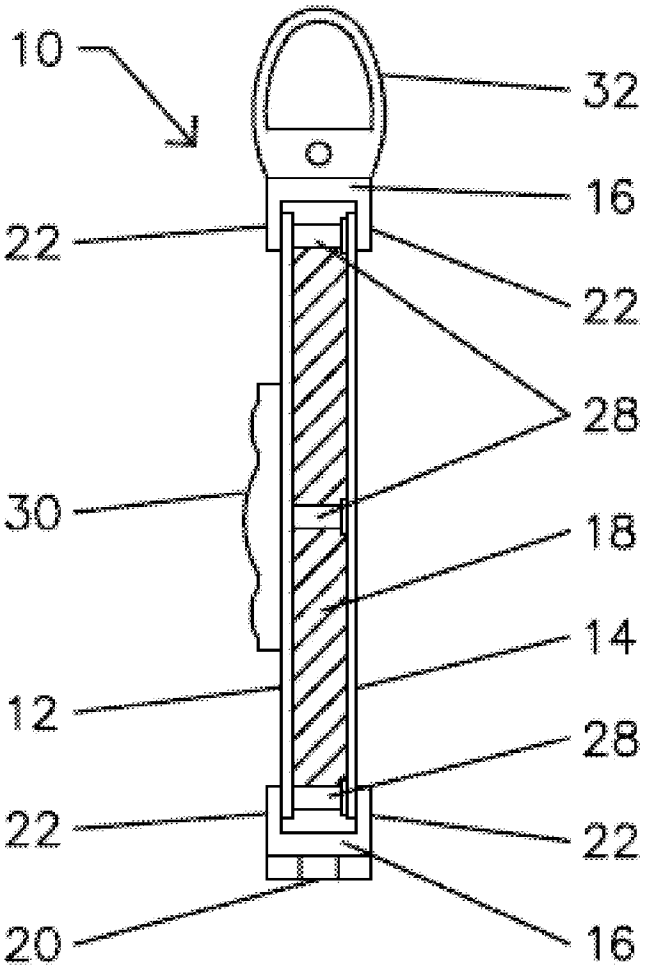

FIG. 6 illustrates section view A-A from FIG. 2, showing an embodiment of the device 10 with an empty vault 18 and a plurality of post spacers 28 secured to the outside edge of the back face 14 which maintains the open vault space 18 between the front and back faces 12, 14 when the locket is empty.

Figure 7:
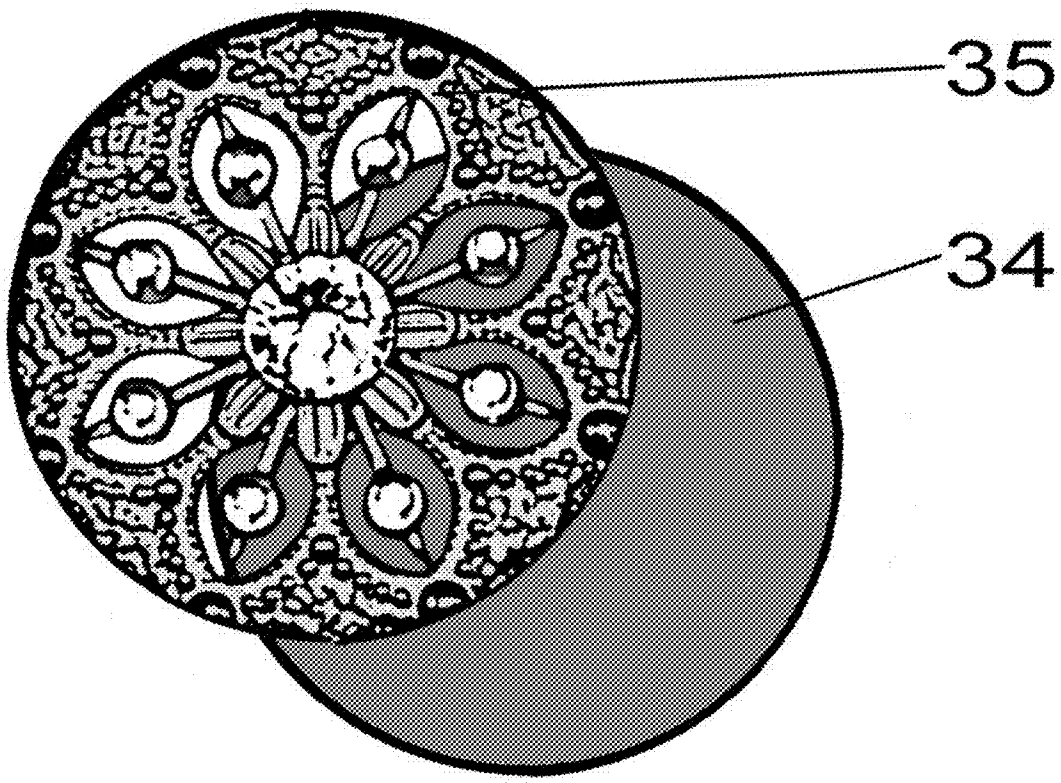

FIG. 7 illustrates an embodiment of a partially transparent face 35.

Figure 8:
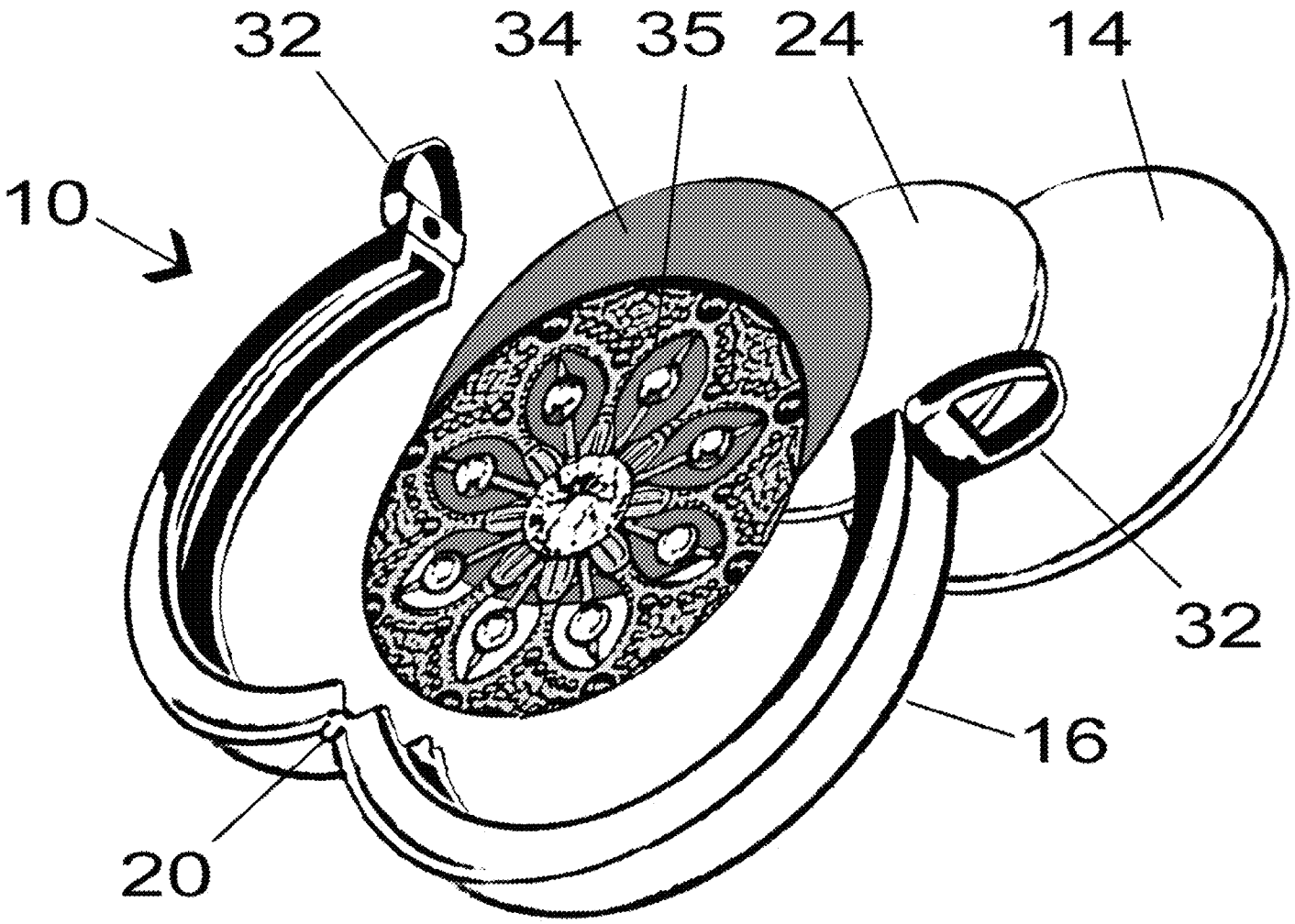

FIG. 8 illustrates a perspective view of an alternative embodiment of the wearable device 10 having a partially transparent face and a backer 34.

DESCRIPTION OF THE PREFERRED EMBODIMENTS

The preferred embodiment of the invention is shown in FIGS. 1-4. Two optional embodiments for adding spacers between the front and back faces are shown in FIGS. 5-6.

As shown in FIGS. 1-4, the preferred device 10 comprises a front face 12, a back face 14, and a retaining assembly 16. The front and back faces 12, 14 are preferably opaque. In addition, the front and back faces are the same size and are held in place by the sides (i.e., legs) 22 of the channel which is the retaining assembly 16 when hinge 20 is in the closed position (see FIG. 2). When hinge 20 is in the open position, the front face 12 and back face 14 (and anything stored in the hidden compartment 18 between the front and back face) can be removed (and replaced) from the retaining assembly 16 (see FIG. 1).

It is preferred that the interior space between the legs 22 of the channel be wider than the thickness of the front and back faces 12, 14 to create a space (or vault) to hold items. Configuring a device in this way creates a vault 18 (or "internal hidden compartment") to store a personal keepsake 24 (such as a recovery medallion or chip, a small notepad or photo album, money, etc.) between the front face 12 and the back face 14.

One way to keep the perimeter of the front and back faces against the sides 22 of the channel of the retaining assembly 16 is to add a spacer to create an internal hidden vault 18. This spacer is placed between the legs 22 of the channel. Contents placed in the vault created by the spacer will remain hidden from view. As seen in FIG. 5, one embodiment of a spacer is an O-ring 26. Another embodiment of a spacer is one or more posts 28 as seen in FIG. 6. A personal keepsake 24 can be placed in the hidden vault that is created by the spacer.

The front and back faces 12, 14 are preferably rigid and adorned with ornamental objects or other decorations. The front and back faces 12, 14 can also been engraved, embossed, carved or any other method of adornment. Because the front and back faces 12, 14 are removable when the retaining assembly 16 is in the open position, the front and back faces are changeable by the user. The preferred method of securing the retaining assembly 16 is with a closing device, such as a standard lobster claw clasp (not illustrated) can be used to hold the device 10 in the closed position by connecting it to the bail 32 of the retaining assembly 16. Other methods can be used such as a split ring, knotted cord or ribbon, or simply stringing a chain thru the bail 32 without the closing device.

In another embodiment, the front (or back) face can be transparent or partially transparent. FIG. 7 illustrates an alternative embodiment of a partially transparent face 35. If the user desires to employ a transparent or partially transparent face, but still wants to keep vault 18 hidden, the user can insert backer 34 as shown in FIG. 8. Backer 34 is preferably made of a colored material, but most any material of the right size will suffice.

While the invention has been described by means of specific embodiments, numerous modifications and variations could be made thereto by those ordinarily skilled in the art without departing from the scope and spirit of the invention set forth in the claims.

What is claimed is:

1. A wearable device for hiding keepsakes and valuables, the device comprising, a first face, the first face comprising a first perimeter size, a first perimeter shape and a first thickness, a second face, the second face comprising a second perimeter size, a second perimeter shape and a second thickness, the second face configured to match the first perimeter size and first perimeter shape, a retaining assembly, the retaining assembly comprising a channel-shaped cross section and a hinge, the retaining assembly configured to match the first perimeter shape and be bigger than the first perimeter size to permit the first face and second face to be held between a pair of channel side legs when the hinge is in a closed position, the pair of channel side legs comprising an interior space greater than the sum of the first thickness plus the second thickness, and a spacer disposed between the first face and the second face, the spacer creating an internal vault for storing an item.

2. The wearable device of claim 1 wherein the spacer is shaped like an o-ring.

3. The wearable device of claim 1 wherein the spacer is shaped like a post.

4. The wearable device of claim 1 wherein the first face is opaque.

5. The wearable device of claim 4 wherein the second face is opaque.

6. The wearable device of claim 1, further comprising the item within the internal vault.

7. The wearable device of claim 6 where the item is a sobriety chip.

8. The wearable device of claim 6 where the item is a notepad.

9. The wearable device of claim 6 where the item is a photo album.

10. The wearable device of claim 6 where the item is a medallion.

* * * * *